US006934488B2

(12) United States Patent
Jones, Jr. et al.

(10) Patent No.: US 6,934,488 B2
(45) **Date of Patent: *Aug. 23, 2005**

(54) METHOD AND APPARATUS FOR REASSEMBLING A TONER CARTRIDGE

(75) Inventors: James H. Jones, Jr., Fayetteville, NC (US); Erick T. Colbert, Apex, NC (US); Warren F. Brannan, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/899,284

(22) Filed: Jul. 26, 2004

(65) Prior Publication Data

US 2005/0008392 A1 Jan. 13, 2005

Related U.S. Application Data

(63) Continuation of application No. 10/439,432, filed on May 16, 2003, now Pat. No. 6,801,734.

(51) Int. Cl.[7] ..... G03G 15/00
(52) U.S. Cl. ..... 399/109; 156/73.5; 399/119
(58) Field of Search ..... 399/107, 109, 399/110, 111, 113, 119; 156/73.1, 73.5

(56) References Cited

U.S. PATENT DOCUMENTS 5,163,265 A 11/1992 Darcy et al.
5,525,183 A 6/1996 Baley
5,829,937 A 11/1998 Morello et al.
5,937,238 A 8/1999 Tremblay et al.
6,058,280 A 5/2000 Kumar et al.
6,079,084 A 6/2000 Gwynn
6,115,570 A 9/2000 Kilian et al.
6,141,513 A 10/2000 Nishiuwotoko et al.
6,256,467 B1 * 7/2001 Yokomori et al. ..... 399/119
6,282,395 B1 * 8/2001 Nittani et al. ..... 399/284
6,381,430 B1 * 4/2002 Yokomori et al. ..... 399/119
6,415,121 B1 7/2002 Suzuki et al.
6,549,736 B2 4/2003 Miyabe et al.
6,563,697 B1 5/2003 Simbeck et al.
6,577,830 B1 6/2003 Wazana et al.

* cited by examiner

*Primary Examiner*—Hoan Tran

(57) ABSTRACT

In the toner cartridge recycling and remanufacturing industry, used xerographic toner cartridges are reconditioned and refilled with toner. There are various types and models of toner cartridges, each having unique physical properties. The present invention is directed to the reassembling of toner cartridges that may not have sufficient securing surfaces to allow the cartridge to be physically held together using an external securing device. The present invention will also enable the toner cartridges to be more efficiently remanufactured by allowing a quick connect or disconnect during the assembly or disassembly process.

14 Claims, 9 Drawing Sheets

METHOD AND APPARATUS FOR REASSEMBLING A TONER CARTRIDGE

This application is a continuation of allowed U.S. patent application Ser. No. 10/439,432 entitled, "Method and Apparatus for Reassembling a Toner Cartridge" and filed on May 16, 2003 now U.S. Pat. No. 6,801,734, which is incorporated by reference herein in its entirety.

BACKGROUND

Many imaging devices such as copiers, laser printers, and facsimile machines use toner cartridges. The toner cartridge contains many of the moving parts of the machine and contains a finite supply of toner. The original equipment manufacturers (OEM) intended for the consumer to use the toner cartridge until the initial toner supply is exhausted, and then replace it with a new laser toner cartridge. By placing many of the moving parts in the toner cartridge and making the toner cartridge disposable, the OEM reduced the amount of repair work required on the printers, copiers, or facsimile machines.

The used toner cartridge has many components that may be recycled. An industry known as the remanufacturing industry has arisen to take advantage of this fact. Remanufacturers take used toner cartridges, clean them, repair damaged components, replace worn out components, add new toner, and reintroduce these refurbished cartridges into the marketplace.

In the original manufacturing process, the OEM takes a toner hopper reservoir, seals it, and then ultrasonically welds it to a developer roller housing, creating a combined unit, the toner hopper assembly. The toner hopper assembly is further combined with a waste bin assembly and various other components until the toner cartridge is fully assembled.

In the remanufacturing assembly process, the remanufacturers must first disassemble the cartridge before they can refurbish the cartridge. The disassembly process is in reverse order of the assembly procedure. Access to the various subcomponents can only be accomplished by tearing the cartridge down to its basic parts. By separating the toner hopper reservoir from the developer roller housing, remanufacturers duplicate the condition the cartridge was in when it was new. In the remanufacturing process, after remanufacturers place a seal over the toner hopper discharge opening, they reattach the toner hopper reservoir to the developer roller housing, and continue on with the complete reassembly of the toner cartridge.

As explained in U.S. Pat. No. 6,240,605 to Jerry Stevens, remanufacturers can use a clip system to mechanically compress the developer roller housing against the toner hopper reservoir. The clamping clips are applied at two flanges, a forward and a rear flange, which are created at the juncture where the developer roller housing and the toner hopper reservoir are joined together. By using a clamping clip, instead of glue, a remanufacturer may simply and easily separate the cartridge on its next remanufacturing cycle by simply removing the clips and separating the developer roller housing from the toner hopper reservoir. No sawing is required on the second cycle when a reusable clip system is used.

However, a unique issue has arisen in newer toner cartridges. In these different cartridges, when the toner hopper reservoir and the developer roller housing are mated together, only one combined flange is created. Therefore, only one side of the combined assembly may be clamped using these clamping clips. The other side of the combined assembly lacks the surface area, a lip or protrusion to mount any type of clamping device like the clip. The only option would be to bond the two surfaces together by either gluing or welding the joint. The present invention introduces a way of creating a mounting surface to alleviate this issue and provide a way to secure the area without a flange.

SUMMARY

In the case where no easily externally connectable surfaces exist on a toner cartridge that is being reassembled, one will need to be introduced in order to efficiently reconnect the pieces. A securing fixture will provide one of the means to secure a toner hopper reservoir to a developer roller housing without having to glue or ultrasonically weld the two pieces together. The securing fixture will have a lip that will protrude above the surface that it is mounted to. In addition, the securing fixture will have a bottom surface such that this bottom surface will be able to provide enough area to be affixed to the toner hopper reservoir. The securing fixture will be attached to the toner hopper reservoir at a mounting surface, such that the lip of the fixture will extend towards the rear of the hopper and the lip will secure a forward securing edge of the developer roller housing. The securing fixture, when mounted, must not interfere with the over all profile of the cartridge. The cartridge must fit inside the toner cartridge cavity of the printer and the securing fixture's profile must be such that it can fit into this area inside the printer without obstruction.

By securing the developer roller housing to the toner hopper reservoir using the securing fixture, the toner cartridge may more easily be disassembled and reassembled at a later time. The securing fixture needs to be of sufficient length to be able to support the force against the lip being supplied by the forward securing edge. Once this forward securing edge is held in place by the securing fixture, a clip or clips may be used to secure the other side of the combined assembly. The securing fixture is substantially rigid insuring that the developer roller housing and toner hopper reservoir will maintain proper alignment and stiffness.

The preferred embodiment of the present invention provides added rigidity to the toner hopper reservoir and developer roller housing once they are mated together. Other embodiments of this invention may include a type of spring, which by its nature is not rigid. If using a spring to secure the developer roller housing to the toner hopper assembly, the spring may actually be flexed when the two pieces are mated together. Regardless of the type of device used, the joint between the two pieces should be secured sufficiently so that no toner can leak out of this area.

Secondly, the preferred embodiment of the present invention maintains the developer roller housing and toner hopper reservoir in proper alignment. The securing fixture of this invention does so by attaching to the toner hopper reservoir assembly as to hold the developer roller housing in the proper orientation to one another, and by adding a stiffening element perpendicular to the length of the toner hopper and developer roller housing. Additionally, this invention provides an efficient way of reassembling a toner cartridge, which may not have sufficient surface area to attach a clip.

Another advantage of the present invention is that it allows future recycling to be performed with much less effort as the two sections may be separated relatively easily.

The securing fixture will provide a "quick connect" or a "quick disconnect." When using the invention in combination with clips such as those described in Stevens, the cartridge may be recycled numerous times with little or no effort involved in separating the developer roller housing from the toner hopper reservoir. An example of a toner cartridge that can employ the present invention is the HP4200 or HP4300 toner cartridge manufactured by Hewlett-Packard.

BRIEF DESCRIPTION OF THE DRAWINGS

This invention is explained below in detail referring to the accompanying drawings.

DETAILED DESCRIPTION

Figure 1A:
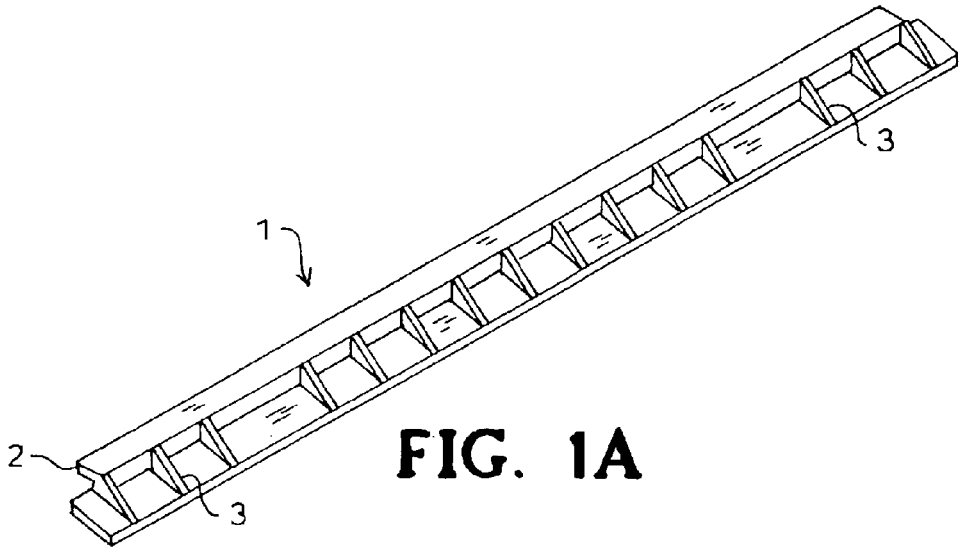
FIG. 1A is front perspective view of the securing fixture.
Figure 1B:
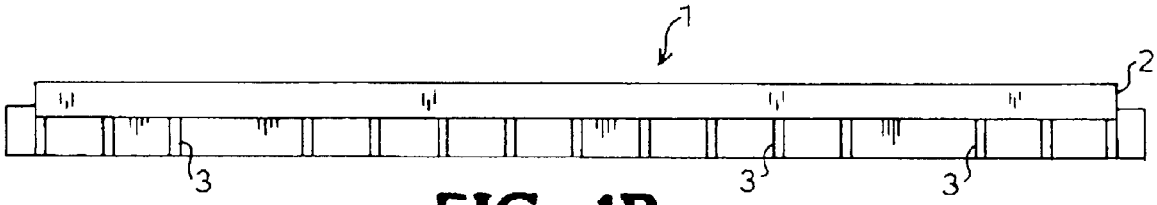
FIG. 1B is top view of the securing fixture.
Figure 1C:
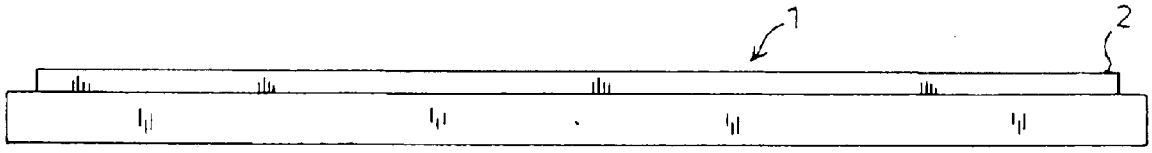
FIG. 1C is bottom view of the securing fixture.

An example of the present invention is illustrated in FIGS. 1A, 1B and 1C. FIG. 1A is a front perspective view of the securing fixture 1. The securing fixture 1 comprises a lip 2 and ribs 3. In the preferred embodiment, the securing fixture 1 is made of plastic. The securing fixture 1 may also be made of aluminum, steel or other types of metals, or other stiff materials. The main requirement would be that the securing fixture 1 be strong enough to absorb an upward force being applied by horizontal foam units 18 (FIG. 4.) through a forward securing edge 7 of a developer roller housing 6 (FIG. 2B) against the lip 2. In the preferred embodiment, the securing fixture 1 may be rigid enough not to flex once this pressure is applied. If using another type of securing device such as a spring or other flexible material, this device may initially flex when the two pieces are mated together and could possibly flex during the life of the cartridge.

In the preferred embodiment, the securing fixture 1 will contain ribs 3, which will help provide support for the lip 2. The ribs 3 are pointed out in FIG. 1A and FIG. 1B. These ribs 3 will keep the lip 2 from bending backwards by distributing the load being applied by the horizontal foam units 18. Preferably, the ribs 3 will extend the entire length of the securing fixture 1, but they may be as simple as a single rib or as complex as a lattice of ribs.

The bottom of the securing fixture 1 as shown in FIG. 1C may be smooth or possibly textured, as long as it provides a sufficient surface area to be attached to the toner reservoir. The main requirement is that it be large enough to provide enough adhesion area. In the preferred embodiment, double-sided tape may be used. If gluing, both the bottom of the fixture and the area where it will be mounted may be grooved in order to allow the glue additional surfaces to bond to.

Figure 2A:
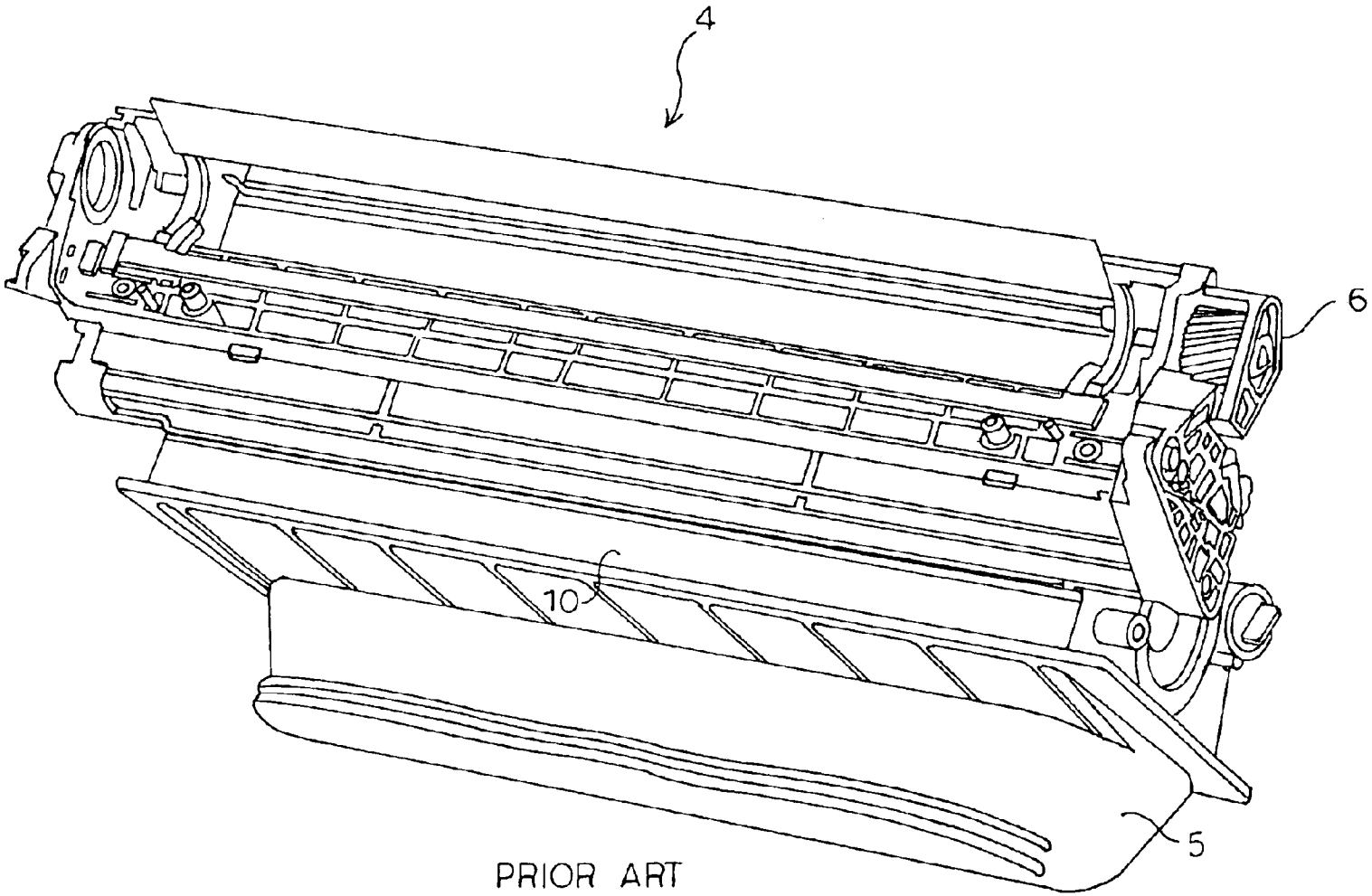
PRIOR ART FIG. 2A
FIG. 2A is a front perspective view of the HP4200 Toner Cartridge (Prior Art).

In the preferred embodiment, the securing fixture 1 will fit within the boundary defined as an upper horizontal securing area 10 on the toner hopper reservoir as shown in the prior art in FIGS. 2A and B. On the HP4200 toner hopper reservoir 5, this area is easily identified because it has raised edges, which define the outline of the upper horizontal securing area 10. As well, the securing fixture 1 may be a single device that extends the entire length equal to that of the forward securing edge 7. An alternative would be to have two or more securing fixtures of varying lengths and sizes as long as the securing fixture(s) fit within the particular securing area.

The length and size of the lip 2 will be determined by the relative force being applied by the forward securing edge 7 as well as the amount of free space available between the developer roller housing and the toner reservoir. The longer the lip 2 extends from the base of the securing fixture 1, the more torque will be applied to the fulcrum or back of the securing fixture 1, and in turn may affect the adhesive or other method of attaching the securing fixture 1 to the toner hopper reservoir 5. As well, the lip 2 may not extend too far as it will interfere with the developer roller housing as it mates up with the toner hopper reservoir. In the preferred embodiment, the lip will extend the full length of the securing fixture 1.

The method of attaching the securing fixture 1 to the toner hopper reservoir 5 may also vary. As previously discussed, the securing fixture may be secured by using a very strong double-sided tape. The tape would need to be strong enough to withstand the upward force being encountered by the lip 2 but not permanent in case the securing fixture 1 itself may need to be replaced. Other alternatives would be to attach the securing fixture with glue or possibly melting it into place. The disadvantage of gluing or melting the securing fixture 1 into place would be that replacing the securing fixture 1 at a later point in time would have to break this adhesive bond and if glued, the separation process could possibly damage the cartridge. Instead of using the securing fixture, ultrasonic welding may also be employed to secure the toner hopper reservoir 5 to the developer roller housing 6, but this process may not be cost effective for a remanufacturer.

An alternative embodiment of the present invention may be to use a leaf spring to hold the developer roller housing 6 in place. The leaf spring would not be rigid per se, but could flex enough to add the extra force necessary to keep the joint secure. The leaf spring could be mounted on the upper horizontal securing area 10, so that it would make contact with the forward securing edge 7 of the developer roller housing 6. It is possible that the leaf spring, once mounted on the upper horizontal securing area 10, may actually touch the weld joint 11 prior to the mating of the developer roller housing 6 to the toner hopper assembly 4. Thus the forward securing edge 7 of the developer roller housing 6 would displace the spring as it was inserted.

FIG. 2A also shows some of the individual parts of an HP4200 toner hopper assembly 4. The toner hopper assembly 4 consists of a developer roller housing 6 and a toner hopper reservoir 5. FIG. 2A also shows a upper horizontal securing area 10, where the securing fixture 1 might be placed. The disassembling of the toner hopper assembly 4 will be covered in greater detail in subsequent sections of this specification.

Figure 2B:
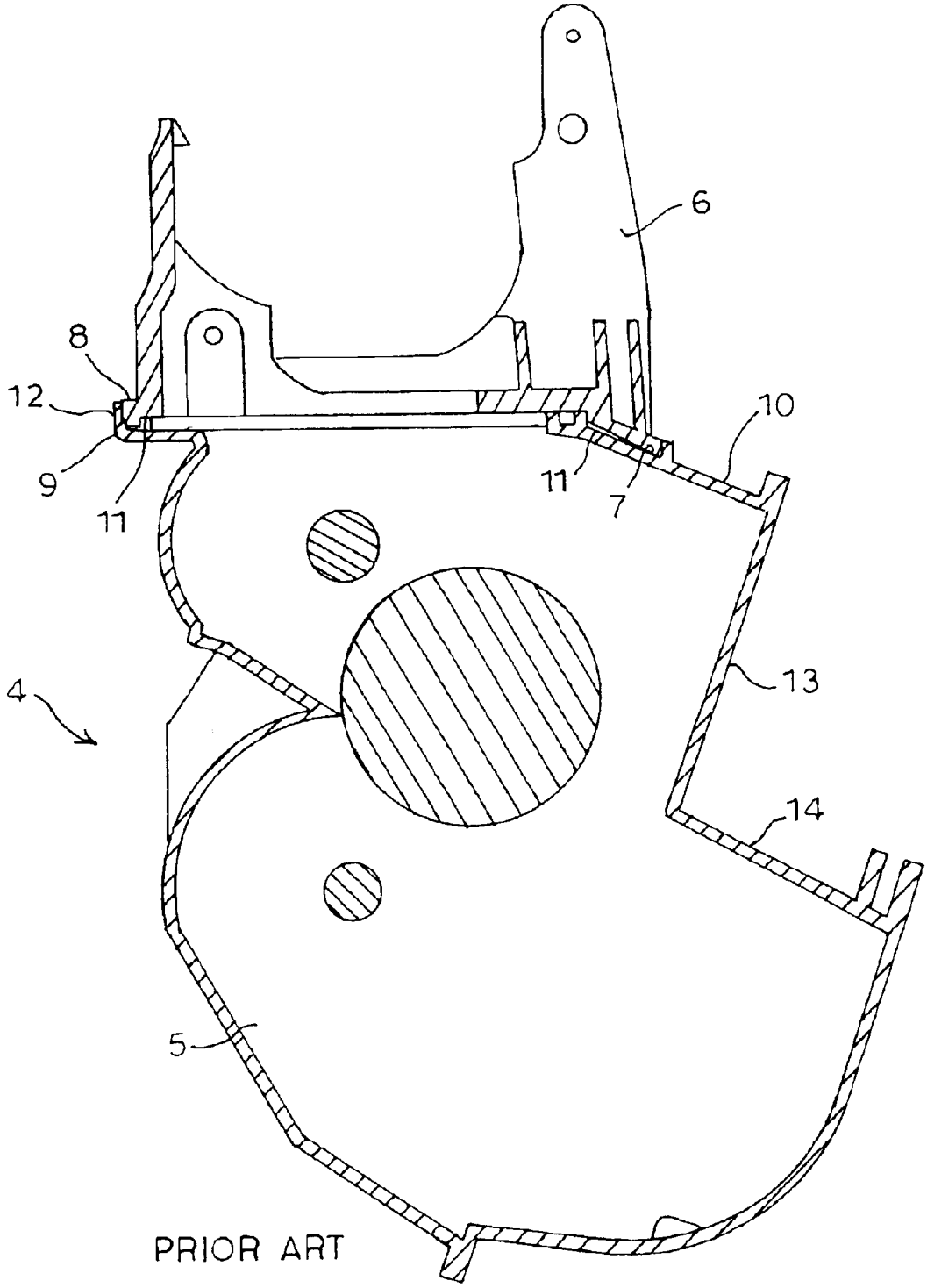
FIG. 2B is a cross sectional view of the HP4200 Toner Cartridge (Prior Art).

FIG. 2B is a cross sectional drawing of the same toner hopper assembly 4. From this drawing it is clear to see how the present invention is necessary to easily reassemble the toner hopper assembly 4 without having to glue or weld the developer roller housing 6 to the toner hopper reservoir 5. In this figure, it is easier to identify the forward securing edge 7 of the developer roller housing 6, which is ultrasonically welded to the toner hopper reservoir 5 in the original OEM assembly. This weld joint 11 is what keeps this side of the toner hopper assembly from separating. There is a corresponding weld joint 11 on the other side of the cartridge. The weld joint 11 on the rear portion of the toner housing assembly 4 is in between the upper rear securing flange 8 of the developer roller housing 6 and a lower rear securing flange 9 which is part of the toner hopper reservoir 5. The combination of the upper rear securing flange 8 and the lower rear securing flange 9 create a combined rear securing flange 12. When separating the developer roller housing 6 from the toner hopper reservoir 5, these weld joints 11 must be severed.

The toner hopper reservoir 5 additionally comprises various other mounting surfaces for the securing fixture 1. In the preferred embodiment, it is on an upper horizontal securing area 10 that the securing fixture 1 will be attached. A different securing fixture I might be designed to attach to a vertical mounting surface 13 or a second horizontal mounting surface 14. The shape of the securing fixture 1 will have to be adjusted accordingly to be able to fit along the contour of the toner hopper reservoir 5 and still provide some type of means to secure the developer roller housing. A securing fixture might also be designed to use the bottom of the toner hopper reservoir 5, which has a raised edge, as a securing location.

Figure 3A:
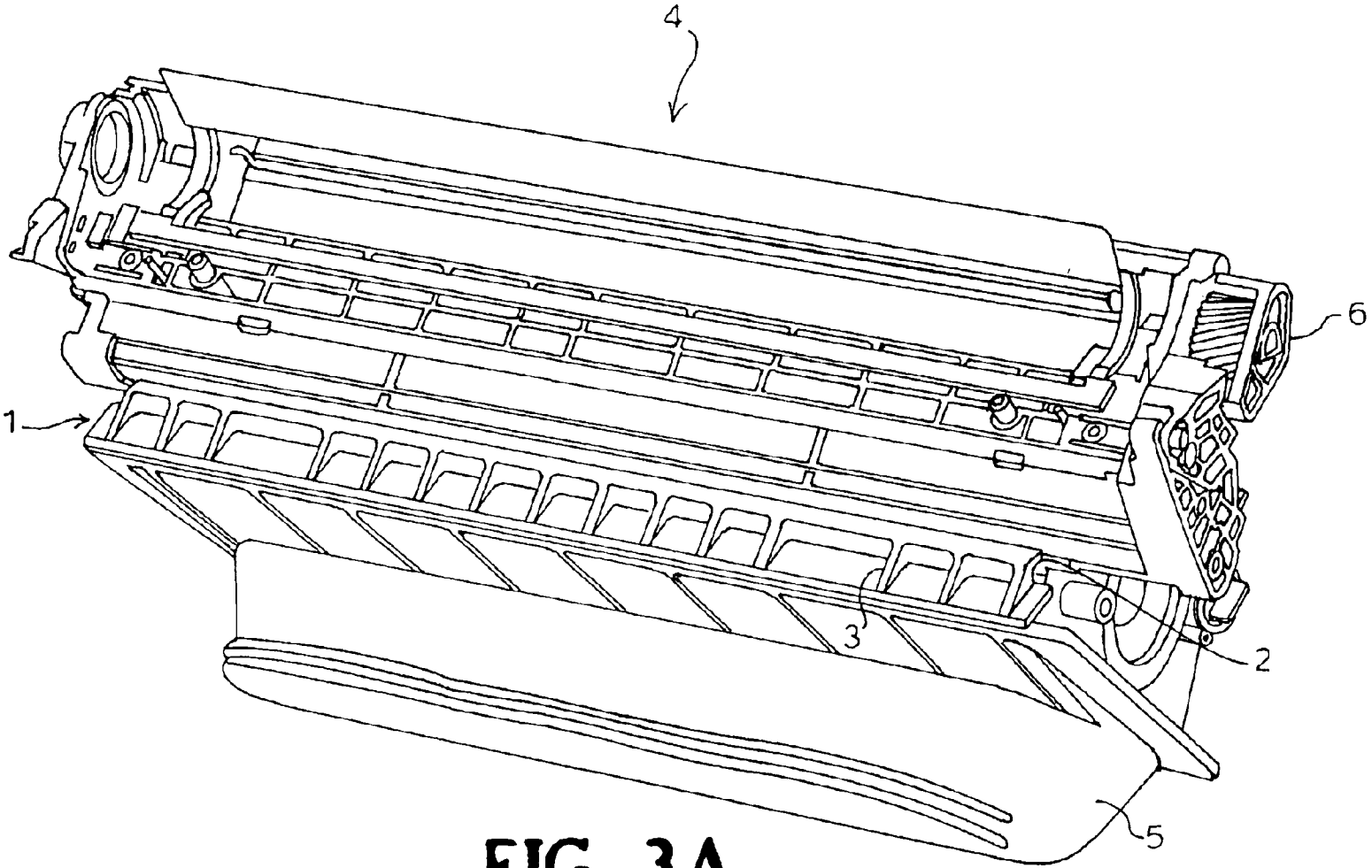
FIG. 3A is a front perspective view of the HP4200 Toner Cartridge with securing fixture attached.
Figure 3B:
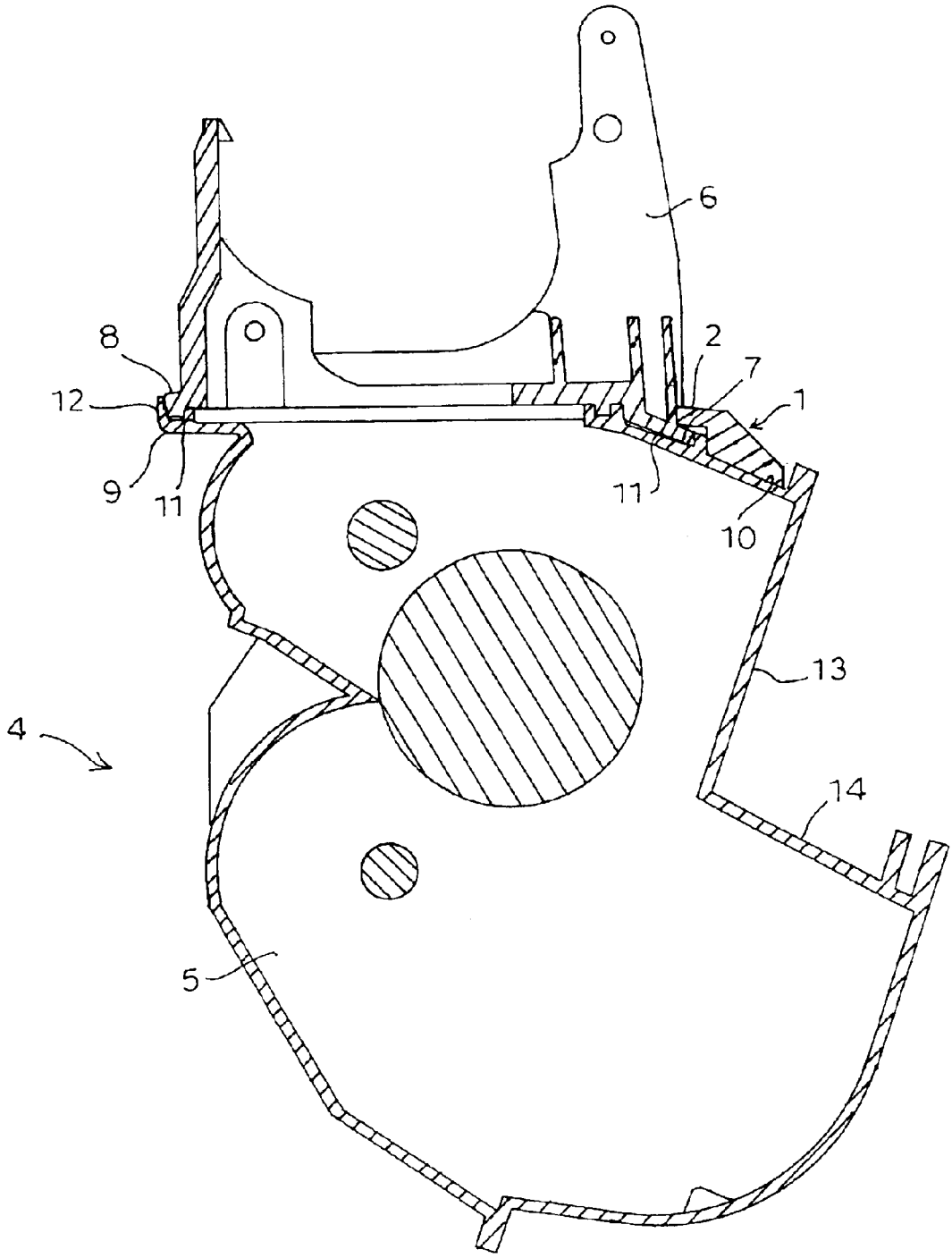
FIG. 3B is a cross sectional view of the HP4200 Toner Cartridge with securing fixture attached.

FIG. 3A shows the same HP4200 toner hopper assembly 4 as illustrated in FIG. 2A except that it has a securing fixture 1 attached. FIG. 3B shows a cross sectional view of an HP4200 toner hopper assembly with the securing fixture 1 attached. In the preferred embodiment, the lip 2 can be seen to protrude roughly parallel to the bottom of the securing fixture 1. In this figure, the width of the securing fixture 1 can be seen conforming to the dimensions of the upper horizontal securing area 10. It is between the bottom of the securing fixture 1 and the upper horizontal securing area 10 that some type of affixing agent would be applied. Also from this figure it can be seen that the forward securing edge 7 of the developer roller housing 6 tucks under the lip of the securing fixture 1. Another type of securing fixture could be made such that it could be attached to both the vertical mounting surface 13 as well as the upper horizontal securing area 10.

Figure 4:
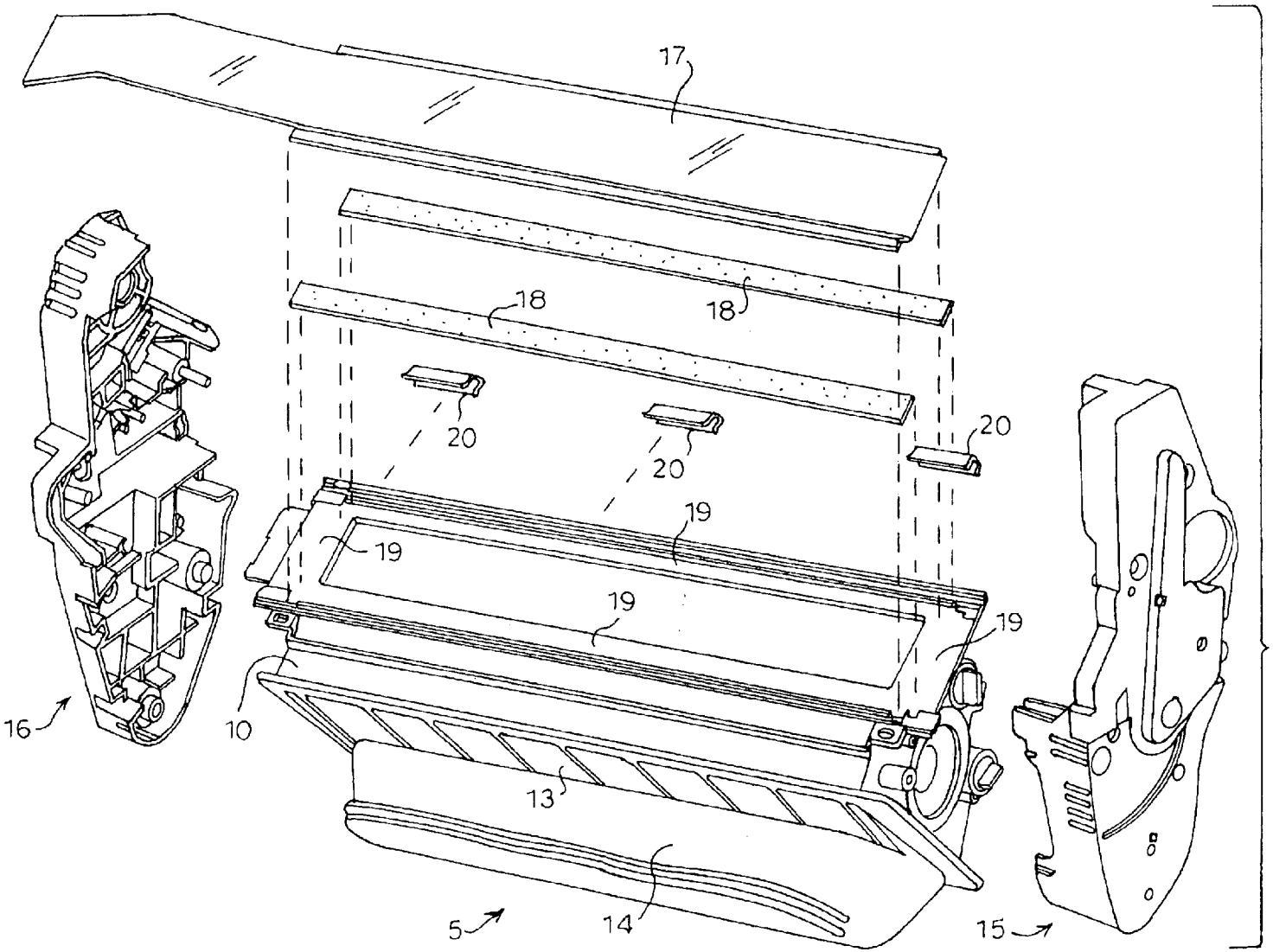
PRIOR ART FIG. 4
FIG. 4 is a front perspective view of the toner hopper reservoir (Prior Art).

When separating the toner hopper assembly 4 into its various subcomponents, different methods and tools may be employed. FIG. 4 illustrates the major components of the toner hopper reservoir 5. On each end of the toner hopper assembly are two endplates, a drive side endplate 15 and a contact side endplate 16. There are several screws holding both endplates in place. Once these screws are removed, the drive side endplate 15 will easily become detached. However on the contact side endplate 16, there are three additional polystyrene welds holding the contact side endplate 16 to the toner hopper assembly 4. Once weakened, these welds can be broken using a flat head screwdriver.

After removal of the endplates 15 and 16, the toner hopper reservoir 5 and the developer roller housing 6 will need to be separated. As discussed previously, this can be accomplished in several ways such as a wedge, a blade or mechanical saw. In cartridges that have both a front and rear combined flange, a unique tool may be employed to remove this ultrasonic weld. This tool is unique in that it may be adjusted to fit various types of cartridges, which may have different sizes and shapes. The blades are very thin so that the weld is the only part being removed. If the blades were too thick, too much material of the toner hopper reservoir 5 or developer roller housing 6 would also be removed.

Figure 5:
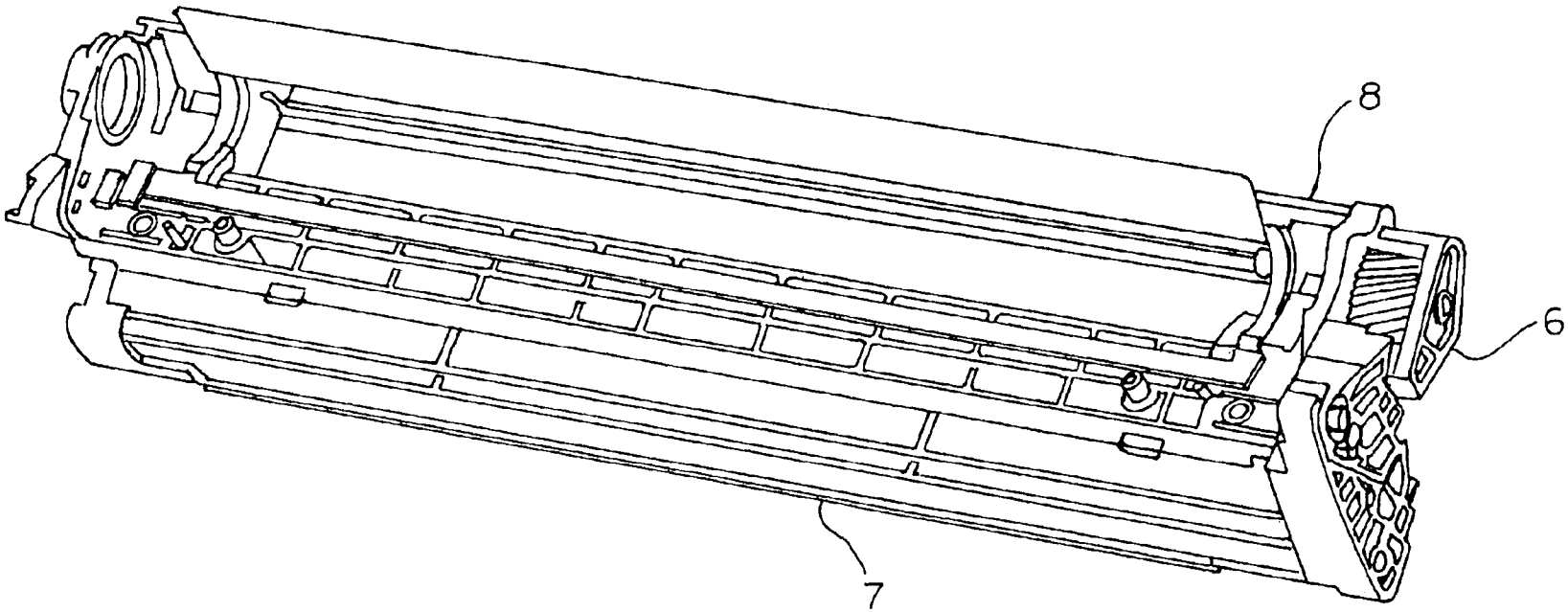
PRIOR ART FIG. 5
FIG. 5 is a front perspective view of the developer roller housing (Prior Art).

The main components of the developer roller housing 6 are shown in FIG. 5. From this illustration, the forward securing edge 7 is clearly visible. As well, at the rear of the developer roller housing 6, is the upper rear securing flange.

An example of the items in the toner cartridge that might need to be replaced may include the OPC drum, PCR, gears, encoder wheels, and wiper blades just to name a few. As well, toner from the waste bin assembly and any remaining toner left over in the toner hopper reservoir 5 will need to be removed. New toner may be added once the cartridge is sufficiently cleaned. There will be various cleaning, prepping and refurbishing procedures that will all be performed in sequence as the cartridge is reconditioned.

The various pieces that will be reassembled on the toner hopper reservoir 5 are illustrated in FIG. 4. A sealing unit 17 will be placed on the toner hopper reservoir 5 at a horizontal sealing surface 19. This sealing unit 17 will keep the toner in the toner hopper reservoir 5 until the cartridge is ready for use. Once the cartridge is delivered to a customer, the customer removes this sealing unit and toner will be allowed to flow up into the developer roller housing 6. In addition, the horizontal foam units 18 will also be placed on the horizontal sealing surface 19. When the developer roller housing 6 is placed on top of these horizontal foam units 18, they will become compressed and will want to expand. Thus these horizontal foam units 18 which provide the force that is exerted on the forward securing edge 7 and applied to the securing fixture 1, keep the developer roller housing in alignment and stationary.

When the developer roller housing 6 is mated to the toner hopper reservoir 5, a combined rear flange will be created on the rear portion of the two pieces. This combined rear securing flange 12 will protrude outward slightly. This protrusion will allow clips 20 to be used to secure the rear portion of the toner hopper assembly 4. One lateral edge of the clip 20 will be touching the upper rear flange 8 of the developer roller housing 6 and the other lateral edge will be in contact with the lower rear flange of the toner hopper reservoir 5. The clamping action of the clip will keep the rear portion secure and in proper alignment. The number of clips used as well as the size and clamping efficiency of the clips may vary depending on the size and shape of the rear combined flange. The main concern for the clips will be the ability to hold the two rear areas together but still be removable for later recycling procedures. Instead of these clips, an alternative manner of attaching these two flanges together may be used such as glue or ultrasonic welding. Gluing the two pieces together would limit the ease of later recycling and ultrasonic welding may prove to be cost ineffective.

Figure 6A:
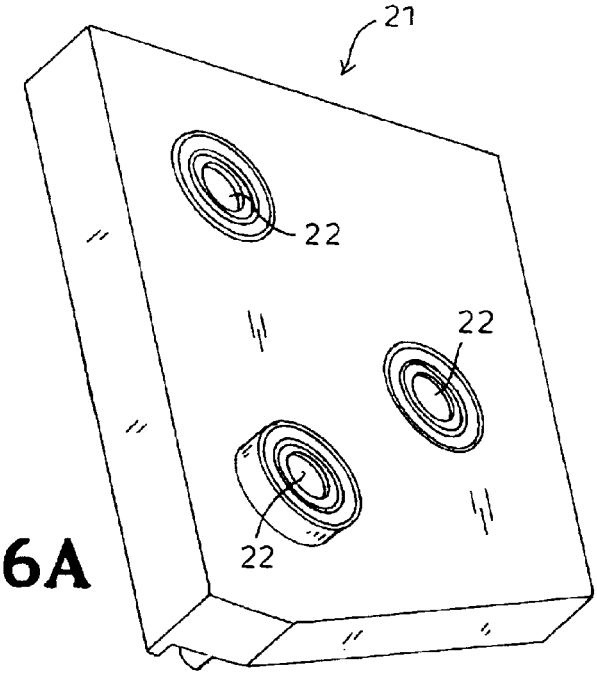
FIG. 6A is a top perspective view of a cleaning template.
Figure 6B:
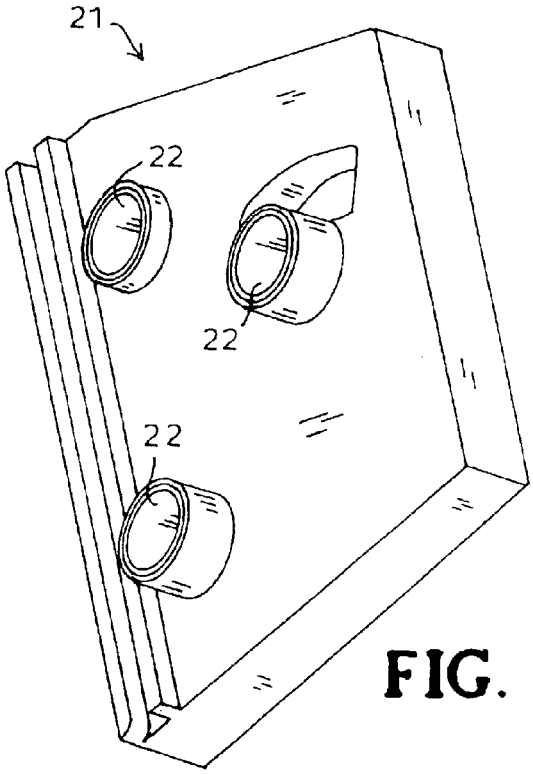
FIG. 6B is a bottom perspective view of a cleaning template.
Figure 7:
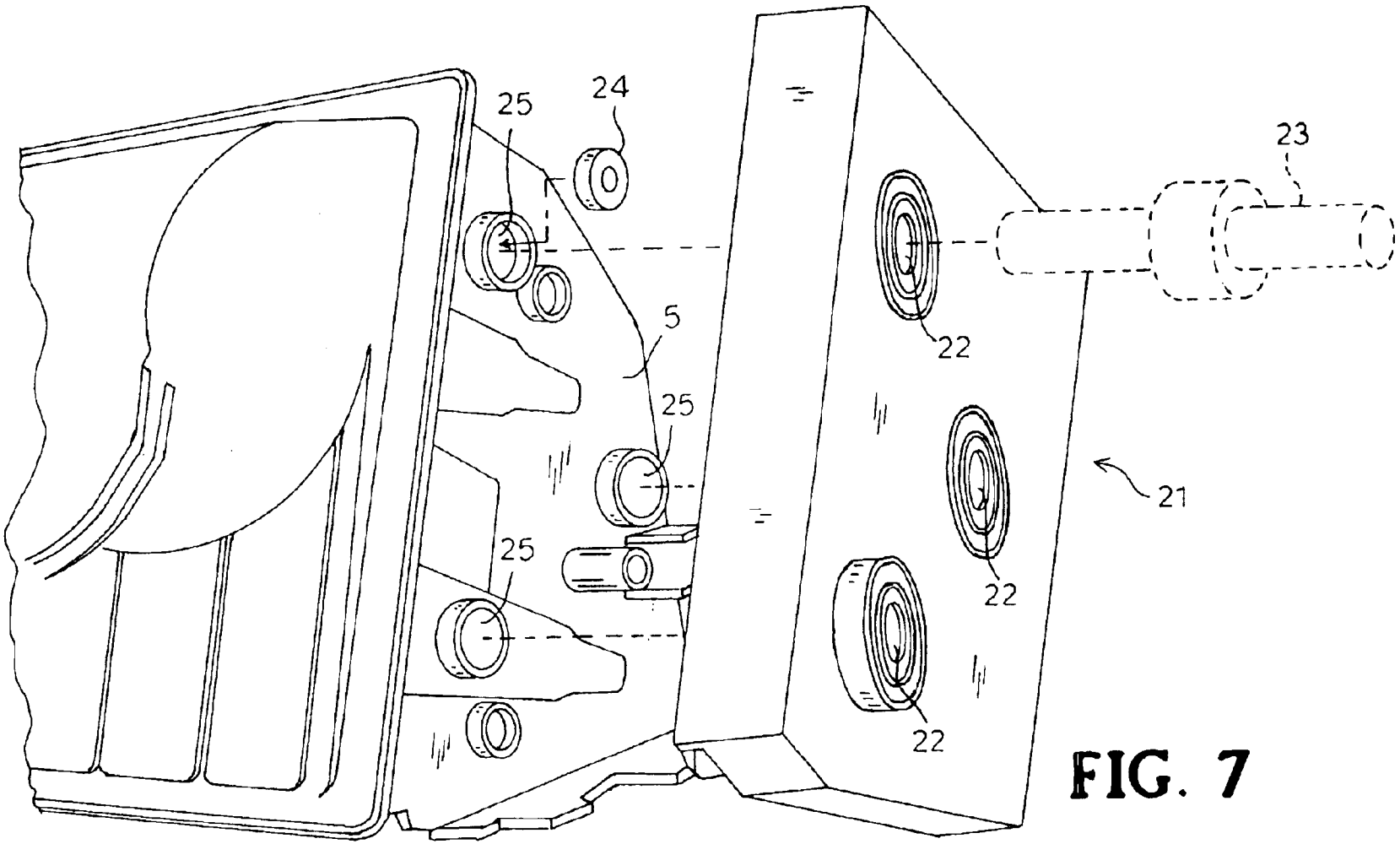
FIG. 7 is a side perspective view of a cleaning template being mounted on a toner hopper reservoir.

Another step required before final assembly will be the preparing of the toner hopper reservoir 5 for the fastening of the contact side endplate 16, as shown in FIG. 4. When the contact side endplate 16 is initially separated from the toner hopper assembly 4, the rivet like structure will need to be cleaned out of the toner hopper reservoir 5 so that a securing anchor 24 (FIG. 7) may be affixed in this location. In order to do this more efficiently, a cleaning template 21 has been created to help uniformly guide a cleaning instrument. The cleaning template 21, shown in FIGS. 6A and 6B will have three holes 22 which line up to the three positions that need to be cleaned. In the preferred embodiment, a set depth drill bit 23 will be utilized to remove this excess material, as shown in FIG. 7. The cleaning template 21 will be placed on top of the toner hopper reservoir 5 and held in place while a drill employing the set depth drill bit 23 will be inserted into the three holes 22. Once this material has been removed, an anchoring fixture 24 will be inserted and affixed into the cleaned orifices 25 and held in place using a permanent type of glue. The contact side endplate 16 will then be able to be secured to the toner hopper reservoir 5 by using a screw, which will pass through the contact side endplate 16 and secure itself into the anchoring fixture 24. The advantage of using this cleaning template 21 along with the set depth drill bit 23 is that the removal of excess material will always be uniform as well as the risk of compromising the toner hopper reservoir 5 will be diminished.

Although this invention has been described with respect to the specific embodiments herein, it should be understood that the invention is not limited to these embodiments, they make take other shapes and forms to accommodate the particular toner cartridges at issue. Other variations and departures from the specific embodiment disclosed herein may also be used without departing from the spirit of this invention.

What is claimed is:

1. An imaging cartridge assembly comprising:

a housing comprising a forward securing edge;

a marking material reservoir comprising a flat securing area; and a securing fixture attached to the flat securing area and at least partially securing the housing to the marking material reservoir.

2. The imaging cartridge assembly of claim 1 wherein the securing fixture comprises a lip extending over the forward securing edge.

3. The imaging cartridge assembly of claim 1 wherein the housing comprises an upper rear securing flange and the marking material reservoir comprises a lower rear securing flange, the imaging cartridge assembly further comprising:

at least one clip attaching the upper rear securing flange to the lower rear securing flange.

4. The imaging cartridge assembly of claim 1 wherein the housing comprises an upper rear securing flange and the marking material reservoir comprises a lower rear securing flange, the imaging cartridge assembly further comprising:

means for attaching the upper rear securing flange to the lower rear securing flange.

5. A securing fixture for at least partially securing a developer roller housing to a toner hopper reservoir comprising:

a bottom base for attachment to a flat securing area of the toner hopper reservoir; and a lip connected to the bottom base for extending over a forward securing edge of the developer roller housing.

6. The securing fixture of claim 5 further comprising:

means for supporting the lip against the bottom base.

7. The securing fixture of claim 5 further comprising:

a plurality of ribs supporting the lip against the bottom base.

8. A method for reassembling an imaging cartridge comprising a housing and a marking material reservoir, said housing comprising a forward securing edge, the method comprising:

attaching a housing securing fixture to a securing area of the marking material reservoir, said housing securing fixture comprising a lip;

mating the housing with the marking material reservoir; and securing the forward securing edge of the housing under the lip of the housing securing fixture.

9. The method of claim 8 wherein the housing securing fixture comprises metal.

10. The method of claim 8 wherein the housing securing fixture comprises plastic.

11. The method of claim 8 wherein the housing securing fixture is attached to the securing area using tape.

12. The method of claim 11 wherein the tape is double-sided tape.

13. The method of claim 8 wherein the housing comprises an upper rear securing flange and the marking material reservoir comprises a lower rear securing flange, the method further comprising:

attaching the upper rear securing flange to the lower rear securing flange.

14. The method of claim 13 wherein the step of attaching the upper rear securing flange comprises the substep of:

attaching at least one clip to the upper rear securing flange and the lower rear securing flange.

* * * * *